United States Patent [19]

Nunn

[11] Patent Number: 4,554,716

[45] Date of Patent: Nov. 26, 1985

[54] APPARATUS FOR TENSIONING AND FORWARDING TOW

[75] Inventor: Gary F. Nunn, Summerville, S.C.

[73] Assignee: E. I. Du Pont de Nemours and Company, Wilmington, Del.

[21] Appl. No.: 591,847

[22] Filed: Mar. 21, 1984

[51] Int. Cl.[4] ..... D02G 1/12; D02G 1/20

[52] U.S. Cl. ..... 28/263; 28/289

[58] Field of Search ..... 28/263, 264, 266, 289

[56] References Cited

U.S. PATENT DOCUMENTS

| | | | |
|---|---|---|---|
| 3,108,352 | 10/1963 | Haigler, Jr. et al. | 28/266 |
| 3,466,716 | 9/1969 | Hancock et al. | 28/263 |
| 3,765,068 | 10/1973 | Rietjens . | |
| 3,767,360 | 10/1973 | Singh | 28/289 X |
| 3,881,230 | 5/1975 | Arnold et al. | 28/263 |
| 3,965,548 | 6/1976 | James, II et al. . | |
| 4,003,195 | 1/1977 | Fernstrom et al. | 28/289 X |
| 4,069,566 | 1/1978 | Sumitomo et al. . | |

FOREIGN PATENT DOCUMENTS

| | | | |
|---|---|---|---|
| 772924 | 1/1972 | Belgium | 28/266 |
| 46-22883 | 6/1971 | Japan | 28/263 |

*Primary Examiner*—Robert R. Mackey

[57] ABSTRACT

The improvement in a tow delivery apparatus downstream of a crimper of a jet device mounted in the laydown spout of the apparatus in the path of the tow. The jet is operated to tension and forward tow through the spout only during startup of the crimper when operating speed is reached at startup the jet is inactivated.

3 Claims, 5 Drawing Figures

APPARATUS FOR TENSIONING AND FORWARDING TOW

BACKGROUND OF THE INVENTION

This invention relates to a tow delivery apparatus and depositing on a surface in a sinous pattern a running length of yarn or tow composed of a plurality of filaments. More particularly, the invention relates to a jet apparatus for tensioning and forwarding the tow from the exit of a stuffer box crimper during startup of the combination of the crimper and tow delivery apparatus.

In the manufacture of staple or tow from synthetic polymers, such as polyethylene terephthalate, it is convenient to draw the tow bundle while wet, pass the wet tow through a stuffing box crimper to impact a zig-zag crimp and then lay the tow in a sinuous fashion on a conveyor belt which carries the tow through an oven for drying and heat treating the tow to impart desired combinations of properties. Such a combination of steps is described by Hancock et al. in U.S. Pat. No. 3,466,716 dated Sept. 16, 1969. Rietjens in his U.S. Pat. No. 3,765,068 discloses an apparatus and process for use during startup of a crimper whereby a sucker gun is used for stringup of the crimped yarn on a windup. This arrangement is not satisfactory for heavy denier tows in relatively high speed operations.

SUMMARY OF THE INVENTION

The present invention provides an apparatus for tensioning and forwarding heavy denier tow at high speed from the exit of a stuffer-box crimper during startup of the crimper. The tensioning and forwarding device is a jet with separable jet halves located on each side of the tow path through a laydown spout directly below the crimper. Each jet half is mounted to the spout for movement toward and away from the tow path by a linkage actuated by an air cylinder. Pressurized air is supplied to the jet halves and the air cylinder to control movement of the linkage. In operation, the jet halves are joined during startup with air being supplied to each half and separated during normal operation of the crimper with air being turned off from the jet halves.

DETAILED DESCRIPTION OF THE PREFERRED EMBODIMENT

Figure 1:
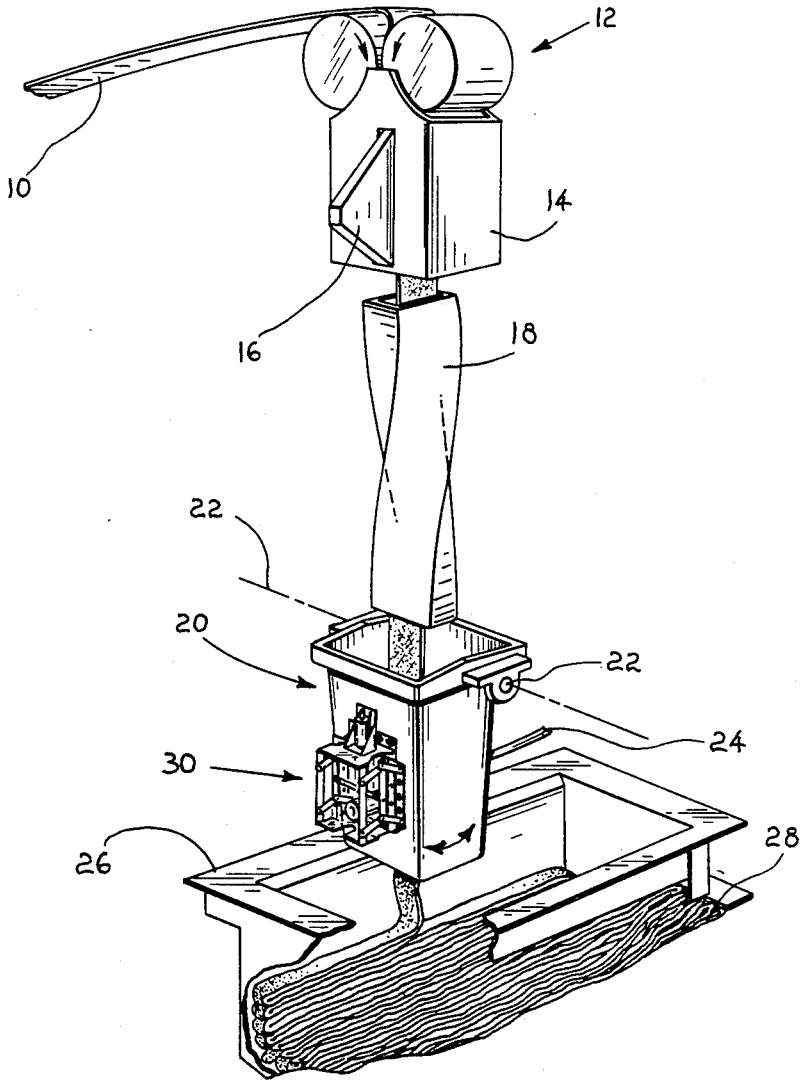
FIG. 1 is a schematic isometric view of apparatus suitable for carrying out the invention and showing the location of the separable jet in the laydown chute.

Referring now to FIG. 1, an uncrimped synthetic fiber multifilament tow 10, usually supplied from a draw machine is passed through a pair of crimper rolls 12 which force the tow under pressure into the crimping-stuffing-box 14. Pressure in the stuffing-box is adjusted by the tension on crimper gate 16. From the stuffing-box the crimped tow falls in a coherent band through a helical chute 18 which rotates the tow band 90° and passes it to a laydown spout 20 which is supported on pivots 22 and driven by drive rods 24. The spout moves back and forth as indicated by the direction arrows and lays the tow down in substantially uniform folds in the J-Box hopper 26. The hopper receives and stacks the folds of tow on top of the other with the flat sides of the tow generally horizontal. Hopper 26 has a smoothly curved lower section which rotates the folds from their original horizontal orientation to a vertical orientation as the tow slides out of the hopper to the conveyor belt 28.

Figure 2:
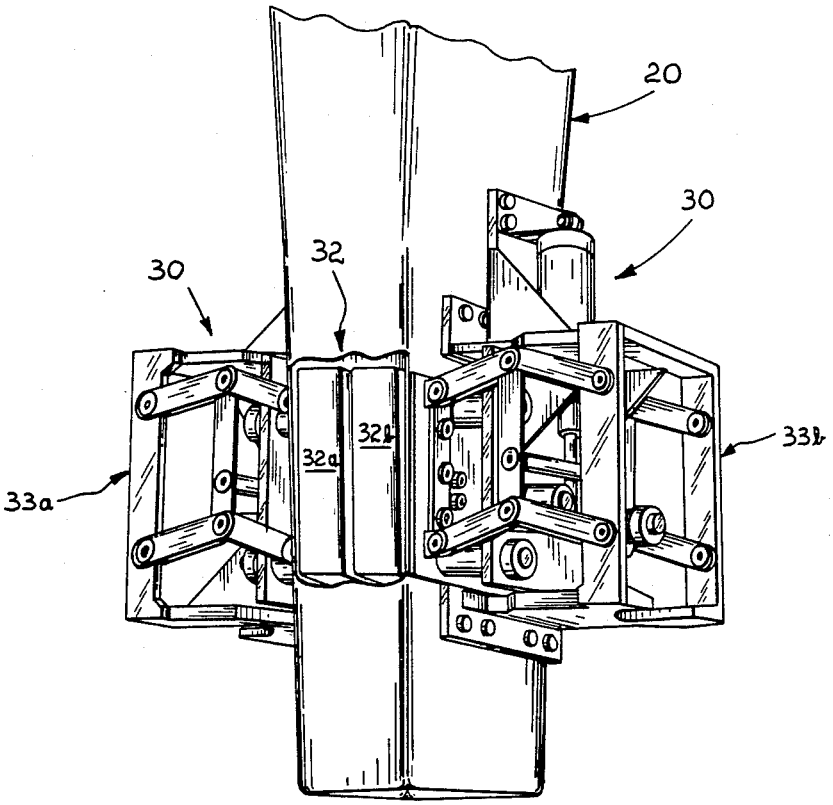
FIG. 2 is an enlarged view of the portion of the laydown chute housing the separable jet.
Figure 3:
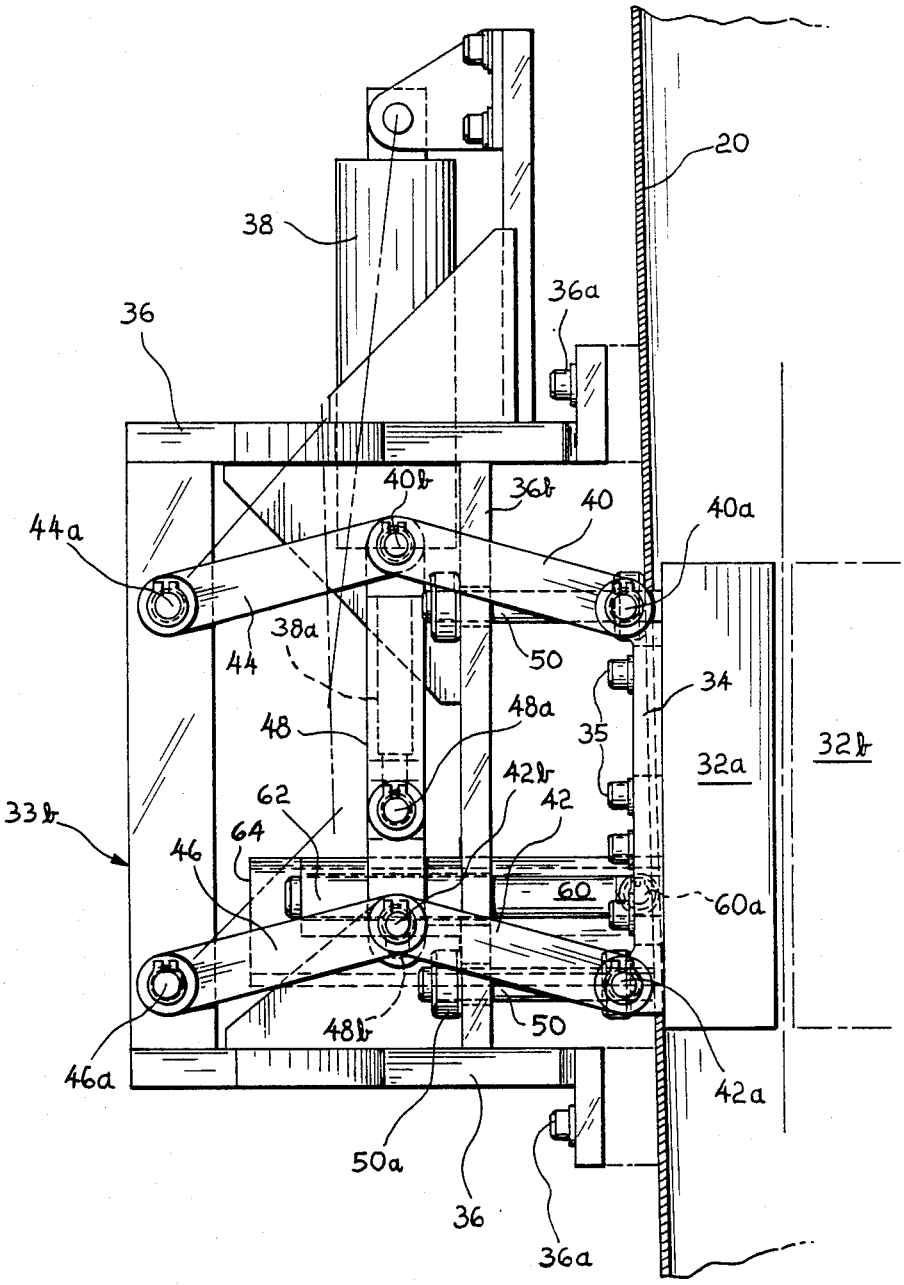
FIG. 3 is a side elevation view of one of the jet halves connected to its linkage.

The jet of this invention along with its mounting linkage is generally designated as 30. As best seen in FIGS. 2 and 3, the jet 32 is formed of separable jet halves **32*a*, 32*b* connected to their respective linkage assemblies 33*a* and 33*b*. To simplify the description, one jet half (32*a*) and its associated linkage (33*a*) and its operation will be described in connection with FIG. 3. The other jet half is constructed and operates in the same manner. Jet half 32*a* is mounted to a plate 34 by cap screws 35. Plate 34 extends through the wall of spout 20 supporting the jet half 32*a* within the spout. A frame 36 is fastened to spout 20 by cap screws 36*a*. Mounted to frame 36 is an air cylinder 38. The linkage assembly comprises five straight links 40, 42, 44, 46 and 48. Links 40, 42 are connected at one end to plate 34 by pivots 40*a* and 42*a* and joined at their other ends to links 44, 46 and 48 by pivots 40*b* and 42*b*. Links 44, 46 are connected to frame 36 by pivots 44*a* and 46*a* while link 48 is connected to the piston rod 38*a* of air cylinder 38 by pivot 48*a*. Link 48 has a slot 48*b* for pivot 42*b* to travel in. During operation this permits overtravel of links 42, 46 with respect to links 40, 44 thus rotating jet half 32*a* to allow it to fit flush with the wall of spout 20 which is slightly inclined. The travel of jet half 32*a* is limited by rods 50 attached to plate 34 at one end and having a stop 50*a* attached to the other end. The rods are slidable in cross member 36*b* of frame 36. A slide 60 is attached to plate 34 by a pivot 60*a* and serves as a guide for jet half 32*a*, during its movement, by moving in bearing assembly 62 attached to frame 36. A flexible hose (not shown) is connected to air fitting 64 to supply air to jet half 32*a***.

Figure 4:
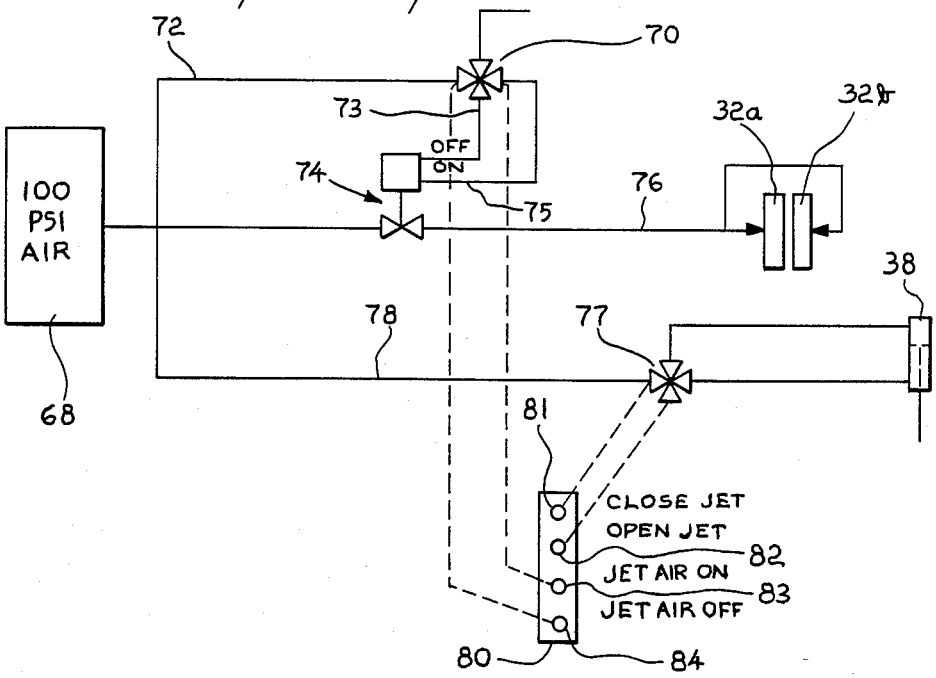
FIGS. 4 and 5 are schematic diagrams of the control features of the separable jet and its linkages.

Referring to FIG 4, pressurized air is supplied from a 100 psi source 68 to an integral regulator four-way solenoid valve 70 through pipe 72. Valve 70 is of the type manufactured by Parker as model 4510 BF2 OA FAE53. Valve 70 supplies pressurized air to the "off" side of ball valve 74 through pipe 73 and to the "on" side of ball valve 74 through pipe 75. Ball valve 74 then supplies pressurized air from source 68 to the jet halves **32*a*, 32*b* through pipe 76. Ball valve 74 may be of the type manufactrured by Jamesbury as "Clencher" model 21-1136TTO with an ST50 actuator. Pressurized air is supplied to air cylinders 38 which actuate linkage assemblies 33*a*, 33*b* through integral regulator solenoid valve 77 and pipe 78. Valve 77 is the same model as valve 70. The control switch 80 for operating the jet is shown schematically tied to the valves 70 and 77, and includes push button 81 to close the jet halves, push button 82 to open the jet halves, push button 83, to turn jet air on, and push button 84** to turn the jet air off.

Figure 5:
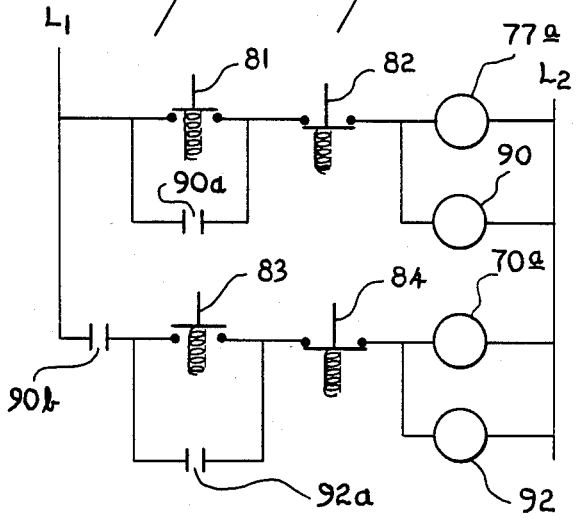

FIG. 5 is an electrical schematic ladder diagram of an interlocking system which prevents pressurized air from being supplied to the jet halves **32*a*, 32*b* when the jet halves are open or away from the tow path. More particularly, in one portion of the circuit, push buttons 81, 82 and the coil 70*a* of solenoid valve 70 are connected in series across $L_1$, $L_2$. A relay 90 is connected in parallel to solenoid valve coil 70*a* and the normally open first contact 90***a* of relay 90 is connected in parallel with normally open push button 81. In another portion of the circuit, push buttons 83, 84 and coil 77*a* of solenoid valve 77 are connected in series across $L_1$, $L_2$. A relay 92 is connected in parallel with coil 77*a* and the normally open contact 92*a* of relay 92 is connected in parallel with push button 83 through contact 90*b* of relay 90 when relay 90 is energized. In operation with the jet in the open position, i.e., jet halves 32*a*, 32*b* away from the tow path, push button 81 is closed causing solenoid valve coil 77*a*, and relay 90 to energize thus closing contacts 90*a* and 90*b*. The solenoid valve 77 operates to supply pressurized air to cylinders 38 causing linkages 33*a*, 33*b* to operate and close the jet halves. Next push button 83 is closed energizing solenoid valve coil 70*a* and relay 92 causing contact 92*a* to close to hold in the circuit. The solenoid valve 70 is energized turning on ball valve 74 thus admitting pressurized air to jet halves 32*a*, 32*b*. In the event the jet is opened by operating push button 82, then relay 90, solenoid coil 77*a* and relay 90 will be deenergized and contacts 90*a* and 90*b* will open deenergizing solenoid coil 70*a* and relay 92 thus cutting off air to the jet.

I claim:

1. In a tow processing apparatus including a stuffing box crimper having crimper rolls to feed tow to the crimper, a J-box operably arranged to receive tow moving in a path from the crimper through an associated piddler spout adapted to oscillate parallel to the nip of the crimper rolls to lay the tow in folds in the J-box and a moving conveyor belt arranged to carry the folded tow from the J-box during normal operation, the improvement in apparatus for tensioning and forwarding the tow as it passes from the crimper through the spout during startup comprising: a jet having separable jet halves located on each side of said path in said spout, each jet half being mounted to said spout for movement by a linkage toward said path to be joined together during startup and away from said path to be separated during normal operation; means connected to each said linkage for movement thereof; means to supply pressurized fluid to each of said jet halves when they are joined together and to discontinue to supply pressurized fluid when they are apart; and control means for actuating the movement of said jet halves and for controlling the supply of pressurized fluid.

2. The apparatus of claim 1, said means connected to each said linkage for movement thereof being an air cylinder.

3. The apparatus as defined in claim 2, including an interlock system to prevent fluid from being supplied to the jet halves when said jet halves are away from said path.

* * * * *